US005112445A

United States Patent [19]

Winston, Jr. et al.

[11] Patent Number: 5,112,445

[45] Date of Patent: May 12, 1992

[54] GELLAN GUM SIZING

[75] Inventors: Philip E. Winston, Jr., San Diego; Harold D. Dial, El Cajon; Kenneth Clare, Vista; Theresa M. Ortega, San Diego, all of Calif.

[73] Assignee: Merck & Co., Inc., Rahway, N.J.

[21] Appl. No.: 370,496

[22] Filed: Jun. 23, 1989

[51] Int. Cl.[5] ..... D21H 17/31; D21H 17/24; D21H 17/26

[52] U.S. Cl. ..... 162/178; 8/115.6; 162/135; 162/158; 162/164.1; 162/177; 106/209; 106/163.1; 106/169; 106/170

[58] Field of Search ..... 536/114, 1, 119; 106/209, 163.1, 169, 170; 8/115.6; 162/135, 158, 164.1, 177, 178

[56] References Cited

U.S. PATENT DOCUMENTS

| | | | |
|---|---|---|---|
| 4,312,675 | 1/1982 | Pickens et al. | 106/205 |
| 4,326,053 | 4/1982 | Kang et al. | 106/205 |
| 4,503,084 | 3/1985 | Baird et al. | 426/573 |
| 4,517,216 | 5/1985 | Shim | 426/573 |
| 4,594,108 | 6/1986 | Greminger et al. | 106/170 |
| 4,647,451 | 3/1987 | Piechota | 424/52 |
| 4,726,809 | 2/1988 | De Boer et al. | 106/210 |
| 4,859,208 | 8/1989 | Clare et al. | 426/573 |
| 4,869,916 | 9/1989 | Clark et al. | 426/573 |

OTHER PUBLICATIONS

Baird et al., Bio/Technology, Nov. 1983, pp. 778–783 (see p. 781).

Kang et al., Some Novel Bacterial Polysaccharides of Recent Development pp. 231–253 (see p. 240).

Sanderson et al., Food Technology, Apr. 1983, pp. 63–70 (see pp. 66 and 68).

Kirk-Othmer, Encyclopedia Chem. Techn. vol. 16, 3rd Edition, 1981, p. 820.

*Primary Examiner*—Ronald W. Griffin

*Attorney, Agent, or Firm*—Gabrial Lopez; Richard S. Parr; Charles M. Caruso

[57] ABSTRACT

Surface sizes comprising 1) gellan gum and 2) one or more film-forming polymers such as chemically modified starch, cellulose derivatives, and polyvinyl alcohol are described. The compositions exhibit enhanced film-forming properties.

2 Claims, No Drawings

GELLAN GUM SIZING

BACKGROUND OF THE INVENTION

Surface sizing, as it relates to paper manufacture, is the application of a non-pigmented coating to the surface of a paper web to improve the smoothness and tensile strength of the paper for subsequent coating or printing, as well as to enhance the grease resistance of the paper.

Starch (which is produced from corn, waxy maize, tapioca, wheat, potato, and rice) is the largest volume product used commercially for surface sizing of paper. Other hydrocolloids which may be used either alone or in combination with starch include polyvinyl alcohol, carboxymethyl cellulose, wax emulsions, and alginates. It is well known that starch covers the paper surface very irregularly, and a continuous film cannot be easily applied unless a high concentration of the starch is used. Typical concentrations range from 6–12%, depending on the paper qualities desired. The starch is mixed with water, heated to swell the starch granules and solubilize amylose molecules, and the dispersion cooled to form a gel or paste. Because of the tendency for native or unmodified starch to retrograde or increase in viscosity following the normal cooking process, chemically modified or reduced-viscosity starches are generally used in paper sizes. These include oxidized, cationic, hydroxyethyl ether derivatives, and enzyme-converted starches.

It would be of advantage to have a size which had good film forming properties, such that the size could be applied in an even, non-porous coating that would permit proper sizing of the paper with the optimum quantity size and would also allow control of paper penetration by the size.

Combinations of gellan gum and starch have been disclosed in the art. For example, Baird, et al, Bio/-Technology, Nov. 1983, page 781, teach that it may be desirable to use gellan gum in combination with modified starches to obtain optional product texture and stability. Kang, et al, Some Novel Bacterial Polysaccharides of Recent Development, page 240, teach that gellan gum may be used as a structuring agent to replace or partially replace the starch. Sanderson et al, Food Technology, Apr. 1983, teach at page 66, Table 4, a starch jelly formulation containing 6.56% starch and 0.2% gellan gum; at page 68, FIG. 8 amylograph for a 4.8% starch/0.2% gellan gum blend; and at page 68, the advantages of combining starch and gellan gum in pie fillings and puddings. U.S. Pat. No. 4,517,216, Table 1—1 discloses blends of 0.52% gellan gum and 0.25% corn starch.

SUMMARY OF THE INVENTION

It has now been found that blends of gellan gum and film-forming hydrocolloids such as chemically modified or reduced viscosity starch, sodium carboxymethylcellulose, polyvinyl alcohol, and methyl cellulose will produce sizing agents that are useful in controlling porosity in paper and paper-based products. Thus, they are useful for paper sizing and as a binder for pigmented paper coatings.

DETAILED DESCRIPTION

The blends of this invention comprise 0.25–10 wt % gellan gum and 90–99.75 wt % film-forming polymer. The gellan gum is preferably 1–8%. The film-forming size comprises 0.03–0.6 wt % gellan gum, 6–12% film-forming polymer, 0.02–0.2 wt %, gelling salt, and water to 100%, optionally with various additives.

A range of film properties from high brittleness to low brittleness can be prepared depending on the form of gellan gum that is blended with the starch, polyvinyl alcohol, etc. These films are also useful in other applications, e.g. food, adhesives and textiles, where flexibility and high density are required.

By gellan gum is meant the heteropolysaccharide produced from the organism *P. elodea*, which is described in U.S. Pat. Nos. 4,326,052, 4,326,053, 4,377,636, 4,385,123, and 4,503,084.

Another form of gellan gum useful in this invention is a non-brittle, low-acyl form prepared by treating a solution of gellan gum with alkali (e.g., KOH) at room temperature for at least six hours. The treated gum is then neutralized (pH 6.5–7.5) with acid (e.g., $H_2SO_4$) followed by heating to about 90.5° C. for four minutes. The heated gum can then be recovered as by filtration, isopropanol precipitation, drying, and milling. As in U.S. Pat. No. 4,503,084 (Baird et al.), the gellan gum may be in the form of a fermentation broth of the native gum. The present alkali treatment, however, is at room temperature and uses 0.15–0.45 g KOH/g gum, which is a severalfold excess of the amount required to fully deacetylate the gum. This process produces gellan gum with a low (0.1–2.0%) acyl level but which is non-brittle, i.e., having a brittleness value ranging from about 40–70% , which is the maximum for this test as defined below.

In general, the texture profile of a gel can be evaluated in terms of four parameters: modulus, hardness, brittleness, and elasticity. These are standard gel properties that are determined, for example, on an Instron 4201 Universal Testing Machine, which compresses the sample to about ¼ of its original height two times in succession. The sample is compressed twice so that the amount of structure breakdown can be determined.

Brittleness is defined as the first significant drop in the force-deformation curve during the first compression cycle. This is the point of first fracture or cracking of the sample. A gel that fractures very early in the compression cycle is considered to be more brittle or fragile than one that breaks later. Brittleness is measured as the % strain required to break the gel. A smaller brittleness number indicates a more brittle gel at a lower strain level.

To prepare the size, the gum blend is hydrated in deionized water by heating to 100° C. and holding for about 30 minutes. Prior to heating, suitable gelling salts are added. These salts are used to form a gel matrix of the gellan and polymer blend. The gelling salts are as disclosed in the patents referenced above on gellan gum, which are incorporated herein by reference.

The starch, polyvinyl alcohol or cellulose derivatives used in the sizes of this invention may be any commercial material commonly known as being of the type useful in sizes. Many such products are available and are widely described in the literature; see, e.g., Carter, ed., *Making Pulp and Paper* (Crown Zellerbach, 1968), esp. pp. IV-25 et seq. and Hawley, ed., *The Condensed Chemical Dictionary* (8th ed., 1971). Mixtures of these materials may also be used.

There may in addition be other conventional sizing additives in the size, as long as they do not detrimentally affect the film forming function of the gellan gum/-polymer combination. Such additives may include colorants, dispersants, surfactants and so forth. One preferred additive is sodium hexametaphosphate (sold commercially under the trademark CALGON® by Calgon Corporation) as a sequestrant for calcium in the water present in the composition, to prevent unwanted gellation of the gellan gum. The amount of the sodium hexametaphosphate present will be on the order of about 50%-200% of the gellan gum. Other sequestrants include salts of ethylenediaminetetraacetic acid (EDTA) and sodium citrate.

The application of the compositions of this invention to paper and other substrates is done by conventional equipment and methods.

Although the size would form a gel at about 25° C., at the normal operating temperatures in a paper mill, 40°-60° C. the viscosity of these sizes is low, e.g., 20 cP measured on a Brookfield LVT viscometer, spindle 2, at 60 rpm.

The sizes of this invention were analyzed using the following Test Method.

TEST METHOD

A standard base paper e.g. offset grade, was used to evaluate the sizing properties of the gum blends of this invention. The test paper was conditioned at 23° C. and 50% relative humidity (RH). Paper samples were cut to 9"×11" and coated with the test solutions (kept at 60° C.) on an RK Mechanical Coater (Testing Machine Inc., Amityville, N.Y.). The weight of coating "pick-up" was determined and the sized paper was dried using a photoprint drier. The samples were then re-conditioned at 23° C. and 50% RH for 24 hours prior to testing. Porosity of the test papers was determined using both the Gurley Densometer No. 4110 (oil-filled) and No. 4120 (mercury-filled) from Testing Machine Inc., Amityville, N.Y. according to T.A.P.P.I Standard T460 OM-83 and T536 CM-85, respectively. These instruments measure the time in seconds for a given volume of air, e.g. 10 cc or 100 cc, to penetrate the paper specimen test area (1.0 sq. in.).

The invention is further defined by reference to the following examples which are intended to be illustrative and not limiting.

EXAMPLE 1

EVALUATION OF STARCH AND LOW ACYL GELLAN GUM

| Ingredients | Wt. % |
|---|---|
| Hydroxyethyl starch ether | 8.000 |
| Low-Acyl Gellan Gum | 0.050–0.1 |
| Calcium Sulfate Dihydrate | 0.104 |
| Deionized Water to 100% | |
| | 100.000 |

Procedure

The starch, gellan gum and $CaSO_4.2H_2O$ were blended and added to the deionized water in a 500 cc reaction flask connected to a stirrer, condenser heating mantle, and thermometer. The mixture was heated with agitation to 100° C. and held for 30 minutes. The gum solution was then cooled with agitation to 60° C. and used to coat the test papers.

The data of Table I were obtained.

TABLE I

| Test | Wt. % STARCH[1] | Wt. % GUM | DRY PICK-UP (Grams/m²) | GURLEY 4110 DENSOMETER (Secs/100 cc) |
|---|---|---|---|---|
| 1 | 6.0 (Control) | — | 0.60 | 31 |
| 2 | — (Control) | 0.10 | 0.013 | 29 |
| 3 | 8.0 (Control) | — | 0.66 | 39 |
| 4 | 8.0 (Control) | — | 1.13 | 140 |
| 5 | 8.0 | 0.05 | 0.71 | 185 |
| 6 | 8.0 | 0.10 | 0.67 | 150 |
| 7 | 8.0 | 0.05 | 1.17 | 450 |
| 8 | 8.0 | 0.10 | 1.14 | 930 |
| 9 | 8.0 | 0.15 | 1.12 | 840 |
| 10 | 8.0 (Control) | 0.50[2] | 1.15 | 830 |

[1]Hydroxyethyl ether derivative of corn starch
[2]High viscosity sodium alginate, KELGIN QH (Kelco Div., Merck & Co., Inc.)

EXAMPLE 2

EVALUATION OF STARCH AND GELLAN GUM IN TAP WATER

| INGREDIENTS | WT. % |
|---|---|
| Hydroxyethyl starch ether | 8.00 |
| High-acyl gellan gum | 0.10 |
| CALGON ® (sodium hexametaphosphate) | 0.05–0.20 |
| Gelling salt | 0.04–0.23 |
| Tap water to 100% | |
| | 100.00% |

Procedure

Since tap water contains divalent ions which can prevent complete hydration of the gellan gum, a sequestrant was used. Therefore, starch, gellan gum, CALGON and gelling salt were dry blended and added to the tap water with agitation. The procedure followed is as outlined in Example 1.

The data of Table II were obtained. In all cases the pick-up was 1.4 gm/m².

TABLE II

| Test | Wt. % Gum | pH | Gelling Salt Type | Gelling Salt Wt. % | Gurley 4120 Densometer (secs/10 cc) |
|---|---|---|---|---|---|
| 1 | 0.10 | 7.3 | KCl | 0.04 | 492 |
| 2 | 0.10 | 7.3 | KCl | 0.08 | 421 |
| 3 | 0.10 | 7.4 | $MgCl_2.6H_2O$ | 0.12 | 342 |
| 4 | 0.10 | 7.4 | $MgCl_2.6H_2O$ | 0.12 | 364 |
| 5 | 0.10 | 7.4 | — | — | 241 |
| 6 | 0.80[1] | 7.4 | — | — | 150 |

[1]High viscosity sodium alginate, KELGIN HV (Kelco Div., Merck & Co., Inc.)

EXAMPLE 3

EVALUATION OF STARCH AND HIGH ACYL GELLAN GUM AT LOW pH

| INGREDIENTS | WT. % |
|---|---|
| Hydroxyethyl starch ether | 8.0 |
| High-acyl gellan gum | 0.10 |
| CALGON ® | 0.05–0.20 |
| Gelling salt | 0.02–0.04 |
| Tap water to 100% | |
| | 100.00% |

Procedure

The starch, gellan gum, CALGON, and gelling salt were dry blended and added to the tap water, which was pre-adjusted to pH 6.0–6.5 with citric acid, and the procedure continued as outlined in Example 1.

The data of Table III were obtained. In all cases the pick-up was 1.4 gm/m$^2$.

TABLE III

| Test | Wt. % Gum | pH | Gelling Salt Type | Gelling Salt Wt. % | Gurley 4120 Densometer (secs/10 cc) |
|---|---|---|---|---|---|
| 1 | 0.10 | 6.5 | $MgCl_2.6H_2O$ | 0.04 | 567 |
| 2 | 0.10 | 6.4 | KCl | 0.02 | 626 |

TABLE III-continued

| Test | Wt. % Gum | pH | Gelling Salt Type | Gelling Salt Wt. % | Gurley 4120 Densometer (secs/10 cc) |
|---|---|---|---|---|---|
| 3 | 0.80[1] | 7.3 | — | — | 150 |

[1]High viscosity sodium alginate. KELGIN HV.

What is claimed is:

1. A method for sizing paper which comprises coating paper with a composition comprising 0.03–0.6 wt. % gellan gum, 6–12 wt. % film forming polymer, 0.02–0.2 wt. % gelling salt, and water.

2. A method of claim 1 wherein the amount of gellan gum and the amount of film-forming polymer form a ratio of between about 1:99 and about 8:92.

* * * * *